United States Patent [19]

Nishio et al.

[11] Patent Number: 4,783,805

[45] Date of Patent: Nov. 8, 1988

[54] SYSTEM FOR CONVERTING A VOICE SIGNAL TO A PITCH SIGNAL

[75] Inventors: Toshihiro Nishio, Maebashi; Kikuji Wagatsuma, Sagamihara, both of Japan

[73] Assignee: Victor Company of Japan, Ltd., Japan

[21] Appl. No.: 804,174

[22] Filed: Dec. 3, 1985

[30] Foreign Application Priority Data

Dec. 5, 1984 [JP] Japan ..... 59-256860
Dec. 5, 1984 [JP] Japan ..... 59-256861

[51] Int. Cl.[4] ..... G10L 1/00
[52] U.S. Cl. ..... 381/49; 364/513.5
[58] Field of Search ..... 381/36–38, 381/41, 42, 49; 364/513.5

[56] References Cited

U.S. PATENT DOCUMENTS

| | | | |
|---|---|---|---|
| 3,020,344 | 2/1962 | Prestigiacomo | 381/49 |
| 3,852,535 | 12/1974 | Zurcher | 381/49 |
| 3,975,587 | 8/1976 | Dunn et al. | 381/49 |
| 4,060,695 | 11/1977 | Suzuki et al. | 381/42 |
| 4,388,491 | 6/1983 | Ohta et al. | 381/49 |

OTHER PUBLICATIONS

"Speech Recognition & Synthesis Manual" published Aug. 1980 by Japan Industry Engineering Center.

*Primary Examiner*—Peter S. Wong
*Attorney, Agent, or Firm*—Andrus, Sceales, Starke & Sawall

[57] ABSTRACT

A system for converting a voice signal to a pitch signal comprises a first circuit for obtaining a pulse signal having a period corresponding to peak values of an input voice signal, a second circuit for quantizing the output pulse signal of the first circuit and for generating a quantized signal, a third circuit for setting a quantized signal as a preliminary pitch signal which indicates a preliminary pitch when the same quantized signal is successively obtained from the second circuit for a predetermined number of times, and a fourth circuit supplied with the quantized signal from the second circuit and the preliminary pitch signal from the third circuit for correcting the preliminary pitch signal by raising or lowering the preliminary pitch when a pitch described by the quantized signal and the preliminary pitch are not equal to each other. The fourth circuit generates a pitch signal which indicates a pitch of the input voice signal.

10 Claims, 10 Drawing Sheets

START

DET PITCH
40
41
PITCH > PRED VAL?
YES
1/2
42
NO
43
WITHIN 1ST RANGE?
YES
PK = 11
44
NO
45
WITHIN 2ND RANGE?
YES
PK = 10
46
NO
47
WITHIN 3RD RANGE?
YES
PK = 9
48
NO
49
WITHIN 4TH RANGE?
YES
PK = 8
50
NO
51
WITHIN 5TH RANGE?
YES
PK = 7
52
NO
53
WITHIN 6TH RANGE?
YES
PK = 6
54
NO
55
WITHIN 7TH RANGE?
YES
PK = 5
56
NO
57
WITHIN 8TH RANGE?
YES
PK = 4
58
NO
59
WITHIN 9TH RANGE?
YES
PK = 3
60
NO
61
WITHIN 10TH RANGE?
YES
PK = 2
62
NO
63
WITHIN 11TH RANGE?
YES
PK = 1
64
NO
PK = 0
65
66
PK OUT
RETURN

START
121
fn2 MAINTAINED?
YES
NO
122
STORE fn2
123
fn1 MAINTAINED?
YES
NO
124
fn2 STORED?
YES
NO
125
M3 = M3 + 1
127
fn1 = fn2 ?
YES
NO
128
M0 = M0 + 1
129
DIFF = 1 ?
YES
NO
130
M1 = M1 + 1
131
M2 = M2 + 1
126
RESET fn1
RETURN

START
140
PRED TIME ELAPSED?
YES
NO
141
RISE TIM STORED?
YES
NO
142
N3 = N3 + 1
144
TIM DIFF ≥160msec ?
YES
NO
145
N2 = N2 + 1
146
TIM DIFF ≥80msec ?
YES
NO
147
N1 = N1 + 1
148
N0 = N0 + 1
143
CLEAR 1ST MEM
RETURN

SYSTEM FOR CONVERTING A VOICE SIGNAL TO A PITCH SIGNAL

BACKGROUND OF THE INVENTION

The present invention generally relates to systems for converting a voice signal to a pitch signal (hereinafter simply referred to as a voice signal to pitch signal conversion systems), and more particularly to a voice signal to pitch signal conversion system which converts an input voice signal into a pitch signal in accordance with a pitch of the input voice signal.

Recently, a voice signal processing such as voice recognition, speech synthesis and the like are used in various fields. As one kind of voice signal processing, there is a voice signal processing in which the pitch of the voice is detected and the voice is converted into a sound of a scale. This kind of voice signal processing can be used in systems such as a system wherein a song sung by a student is automatically marked by converting a voice signal of the song sung by the student into a pitch signal and comparing the pitch signal with a reference pitch signal which is obtained by converting a voice signal of the song sung by a teacher, a system wherein a voice signal of a song or the like is converted into a sound of a predetermined instrument by converting the voice signal into a pitch signal, a system wherein a music of a song or the like is automatically displayed or printed by converting a voice signal of the song into a pitch signal, and a system wherein an apparatus is controlled responsive to a pitch signal which is obtained by converting a command voice signal.

Conventionally, as methods of carrying out the voice signal to pitch signal conversion, there are methods which employ a waveform processing, methods which employ correlation, and methods which employ spectrum processing.

As an example of the method which employs the waveform processing, there is the zero detection method which carries out the voice signal to pitch signal conversion by use of a repetition pattern of a number of zero crossings. However, according to the zero detection method, it is impossible to carry out an accurate voice signal to pitch signal conversion because a noise component crossing the zero is also detected. In addition, when carrying out the signal processing according to the zero detection method by use of a microcomputer, there is a problem in that the program of the microcomputer becomes complex.

As examples of the methods which employ the correlation, there are the autocorrelation method which carries out the voice signal to pitch signal conversion by detecting a peak of an autocorrelation function of the voice signal waveform and the modified autocorrelation method which carries out the voice signal to pitch signal conversion by use of an autocorrelation function of a residual signal in an LPC analysis (linear-prediction). However, in order to carry out the signal processing according to the autocorrelation method or the modified autocorrelation method, it is necessary to use a memory having a large memory capacity, an analog-to-digital converter, an operation circuit having a complex construction and the like.

As examples of the methods which employ the spectrum processing, there are the cepstrum analysis method which carries out the voice signal to pitch signal conversion by separating fine structure and an envelope of the spectrum by Fourier transform of a logarithm of the power spectrum and the period histogram method which carries out the voice signal to pitch signal conversion by obtaining a histogram of harmonic components of a fundamental frequency on the spectrum and determining the pitch from a common measure of the harmonics. However, it takes time to detect the pitch when the cepstrum analysis method or the period histogram method is used, and these methods are disadvantageous in that it is impossible to carry out the signal processing in real time.

SUMMARY OF THE INVENTION

Accordingly, it is a general object of the present invention to provide a novel and useful voice signal to pitch signal conversion system in which the problems described heretofore are eliminated.

Another and more specific object of the present invention is to provide a voice signal to pitch signal conversion system comprising means for obtaining a pulse signal having a period corresponding to peak points of an input voice signal, means for quantizing the pulse signal, means for setting a quantized signal as a preliminary pitch signal when the same quantized signal is successively obtained for a predetermined number of times, and means for controlling the preliminary pitch signal by raising or lowering the preliminary pitch when the pitch of the quantized signal is not equal to the preliminary pitch.

Other objects and further features of the present invention will be apparent from the following detailed description when read in conjunction with the accompanying drawings.

DETAILED DESCRIPTION

Figure 1:
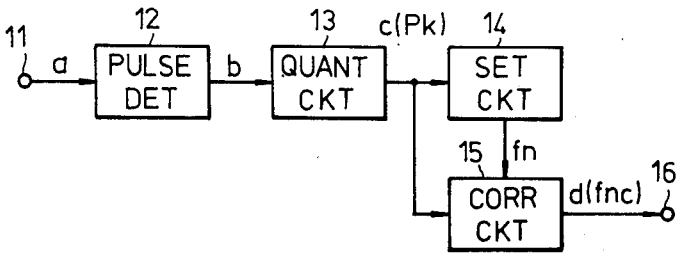
FIG. 1 is a system block diagram showing an embodiment of the voice signal to pitch signal conversion system according to the present invention.

FIG. 1 is a system block diagram showing an embodiment of the voice signal to pitch signal conversion system according to the present invention. For example, a voice signal a shown in FIG. 2(A) comprising syllables "NO", "MA", "SE", and "TE" is applied to an input terminal 11. The voice signal a is supplied to a pulse interval detecting circuit 12, and the pulse interval detecting circuit 12 generates a pulse signal b shown in FIG. 2(A) having a period corresponding to peak points of the voice signal a.

Figure 3:
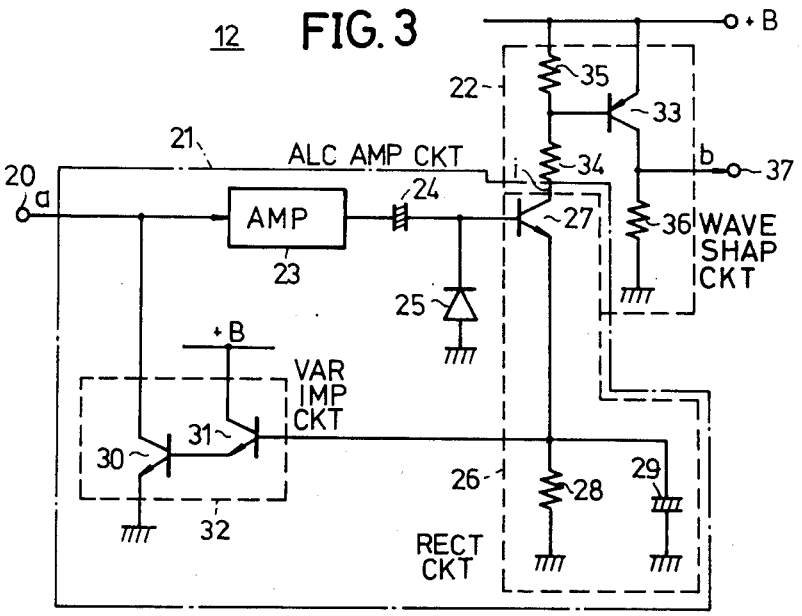
FIG. 3 is a circuit diagram showing an embodiment of a pulse interval detecting circuit in the block system shown in FIG. 1.

An embodiment of the pulse interval detecting circuit 12 is shown in FIG. 3. The pulse interval detecting circuit 12 generally comprises an automatic level control and amplifying circuit (hereinafter simply referred to as the ALC amplifying circuit) 21 and a wave shaping circuit 22. The voice signal a is applied to an input terminal 20 and is supplied to a transistor 27 of a rectifying circuit 26 via a high gain amplifier 23, a D.C. eliminating capacitor 24, and a diode 25 of the ALC amplifying circuit 21. The diode 25 is for discharging the charge of the capacitor. A part of the voice signal a applied to the input terminal 20 is shown on an enlarged scale in FIG. 4(A). Since the voice signal a has a level which is over a predetermined level, a current flows between the base and the emitter of the transistor 27, and this base-emitter current is integrated into a D.C. control signal in an integrating circuit which is constituted by a resistor 28 and a capacitor 29.

Figure 4:
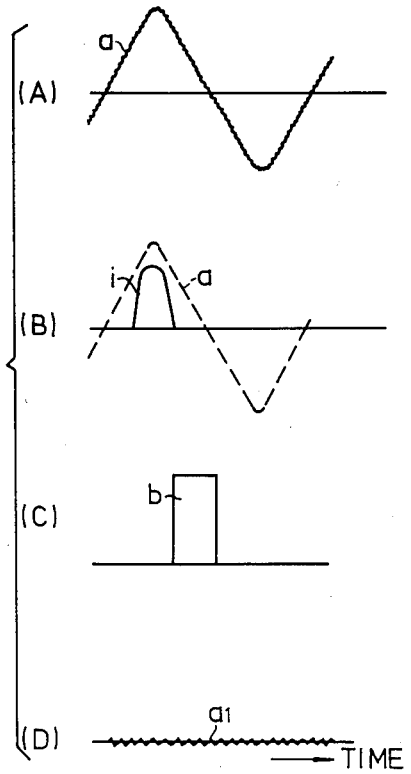
FIGS. 4(A) through 4(D) show signal waveforms for explaining the operation of the pulse interval detecting circuit shown in FIG. 3.

The D.C. control signal is supplied to a variable impedance circuit 32 which is constituted by transistors 30 and 31, and controls the ON and OFF states of the transistors 30 and 31. Accordingly, the input signal level of the amplifier 23 is decreased so that the output signal level of the amplifier 23 becomes constant. At the same time, a current i indicated by a solid line in FIG. 4(B) flows to the collector of the transistor 27, and a base potential of a transistor 33 in the wave shaping circuit 22 is decreased so as to turn the transistor 33 ON. In addition to the transistor 33, the wave shaping circuit 22 comprises resistors 34, 35, and 36. In FIG. 3, a power source voltage is indicated by +B. When the transistor 33 is turned ON, a pulse signal b shown in FIG. 4(C) is obtained through an output terminal 37. The period of this pulse signal b corresponds to the peak points of the voice signal a.

In the case where the voice signal a applied to the input terminal 20 is a noise a1 shown in FIG. 4(D), no base-emitter current (rectified current) flows between the base and the emitter of the transistor 27 because the level of the noise a1 is low. As a result, no output is obtained through the output terminal 37. Therefore, when the noise a1 is applied to the input terminal 20 as the voice signal a, no pulse signal b is obtained.

Returning now to the description of FIG. 1, the pulse signal b from the pulse interval detecting circuit 12 is supplied to a quantization circuit 13 and is quantized in accordance with the frequency of the pulse signal b. Hence, the quantization circuit 13 generates a quantized signal c shown in FIG. 2(C). The operation of the quantization circuit 13 may be carried out by use of a microcomputer, and the operation of the microcomputer in this case is shown in the flow chart of FIG. 5. For example, a microcomputer μPD1512AC manufactured by Nippon Electric Co., Ltd. of Japan may be used for the microcomputer which is to carry out the operation of the quantization circuit 13.

Figure 5:
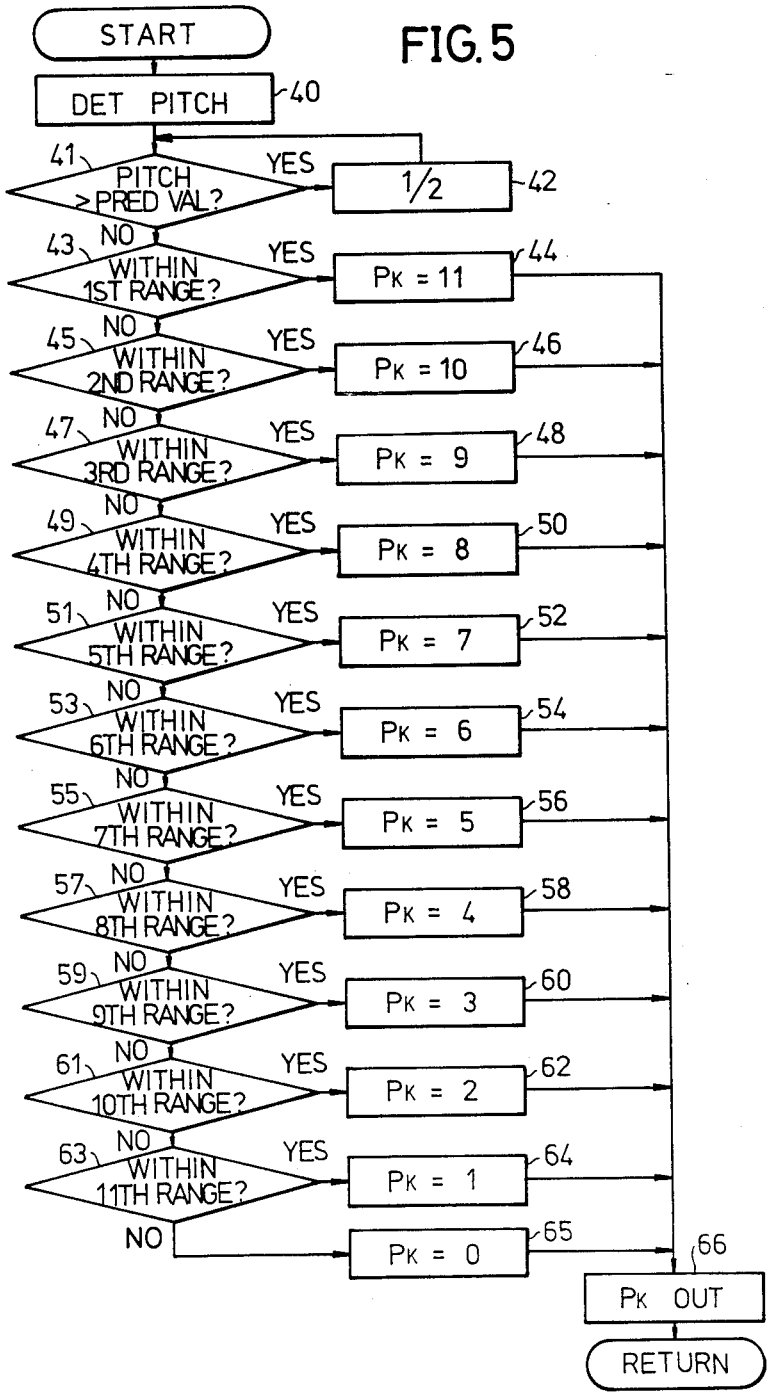
FIG. 5 is a flowchart for explaining an embodiment of the operation of a microcomputer when a quantization circuit in the block system shown in FIG. 1 is constituted by the microcomputer.

In FIG. 5, a step 40 detects from the pulse signal b the pitch of the voice signal. A step 41 discriminates whether or not the detected pitch is higher than a predetermined value (pitch). When the discrimination result in the step 41 is YES, a step 42 multiplies ½ to the pitch and the operation is returned to the step 41. When the discrimination result in the step 41 becomes NO, a step 43 discriminates whether or not the pitch is within such a first range that the pitch can be recognized as a pitch name described by a quantization level "11". When the discrimination result in the step 43 is YES, a step 44 sets the pitch $P_k$ to the quantization level "11". On the other hand, when the discrimination result in the step 43 is NO, a step 45 discriminates whether or not the pitch is within such a second range that the pitch can be recognized as a pitch name described by a quantization level "10". When the discrimination result in the step 45 is YES, a step 46 sets the pitch $P_k$ to the quantization level "10". When the discrimination result in the step 45 is NO, a step 47 discriminates whether or not the pitch is within such a third range that the pitch can be recognized as a pitch name described by a quantization level "9". Similarly, steps 48 through 65 are performed. When the step 44, 46, 48, 50, 52, 54, 56, 58, 60, 62, 64, or 65 is performed, a step 66 produces the pitch $P_k$ as an output.

The following table shows the relationships of the frequency of the pulse signal b (voice signal), the pitch name, the quantization level describing the pitch name, and the number of samples when the pulse train of the pulse signal b is sampled at a sampling frequency of 22.77 kHz.

TABLE

| Frequency (Hz) | Pitch name | Quantization level | Number of samples |
|---|---|---|---|
| 830.61 | $G_4$# | 2 | 27 |
| 783.99 | $G_4$ | 1 | 29 |
| 739.99 | $F_4$# | 0 | 30 |
| 698.46 | $F_4$ | 11 | 32 |
| 659.26 | $E_4$ | 10 | 34 |
| 622.25 | $D_4$# | 9 | 36 |
| 587.33 | $D_4$ | 8 | 38 |
| 554.37 | $C_4$# | 7 | 41 |
| 523.25 | $C_4$ | 6 | 43 |
| 493.88 | $B_3$ | 5 | 46 |
| 466.16 | $A_3$# | 4 | 48 |
| 440.00 | $A_3$ | 3 | 51 |
| 415.30 | $G_3$# | 2 | 54 |
| 392.00 | $G_3$ | 1 | 58 |
| 369.99 | $F_3$# | 0 | 61 |

TABLE-continued

| Frequency (Hz) | Pitch name | Quantization level | Number of samples |
|---|---|---|---|
| 349.23 | $F_3$ | 11 | 65 |
| 329.63 | $E_3$ | 10 | 69 |
| 311.13 | $D_3$# | 9 | 73 |
| 293.66 | $D_3$ | 8 | 77 |
| 277.18 | $C_3$# | 7 | 82 |
| 261.63 | $C_3$ | 6 | 87 |
| 246.94 | $B_2$ | 5 | 92 |
| 233.08 | $A_2$# | 4 | 97 |
| 220.00 | $A_2$ | 3 | 103 |
| 207.65 | $G_2$# | 2 | 109 |
| 196.00 | $G_2$ | 1 | 116 |
| 185.00 | $F_2$# | 0 | 123 |
| 174.61 | $F_2$ | 11 | 130 |
| 164.81 | $E_2$ | 10 | 138 |
| 155.56 | $D_2$# | 9 | 146 |
| 146.83 | $D_2$ | 8 | 155 |
| 138.59 | $C_2$# | 7 | 164 |
| 130.81 | $C_2$ | 6 | 174 |
| 123.47 | $B_1$ | 5 | 184 |
| 116.54 | $A_1$# | 4 | 195 |
| 110.00 | $A_1$ | 3 | 207 |
| 103.83 | $G_1$# | 2 | 219 |
| 98.00 | $G_1$ | 1 | 232 |
| 92.50 | $F_1$# | 0 | 246 |
| 87.31 | $F_1$ | 11 | 260 |
| 82.41 | $E_1$ | 10 | 276 |
| 77.78 | $D_1$# | 9 | 292 |
| 73.42 | $D_1$ | 8 | 310 |
| 69.30 | $C_1$# | 7 | 328 |
| 65.41 | $C_1$ | 6 | 348 |

The sampling frequency is selected to 22.77 kHz in order to obtain a resolution of a semitone. Further, in the table, a frequency range between two phantom lines represents an approximate frequency range of the human voice, and a bracket indicates an octave.

For example, the step 40 detects the pitch of the voice signal by detecting the period of the pulse signal b. In other words, as shown in the table, the step 40 detects the number of samples which are obtained by sampling the pulse signal b at the sampling frequency of 22.77 kHz. In this case, the step 41 discriminates whether or not the number of samples is greater than or equal to "65", and the step 42 multiplies ½ to the number of samples when the discrimination result in the step 41 is YES. In addition, the step 43 discriminates whether or not the number of samples is within a range of "32" to "33", and the step 44 sets the pitch $P_k$ to the quantization level "11" when the discrimination result in the step 43 is YES.

The quantized signal c from the quantization circuit 13 is supplied to a preliminary pitch setting circuit 14 and a pitch correcting circuit 15. The preliminary pitch setting circuit 14 sets as a preliminary pitch fn a pitch of a pitch name described by a quantization level when the same quantization level is successively obtained for a predetermined number of times (for example, three times). The operation of the preliminary pitch setting circuit 14 may be carried out by use of a microcomputer, and the operation of the microcomputer in this case is shown in the flow chart of FIG. 6. For example, the microcomputer μPD1512AC manufactured by Nippon Electric Co., Ltd. of Japan which is used for the quantization circuit 13 described before, may also be used for the microcomputer which is to carry out the operation of the preliminary pitch setting circuit 14.

Figure 6:
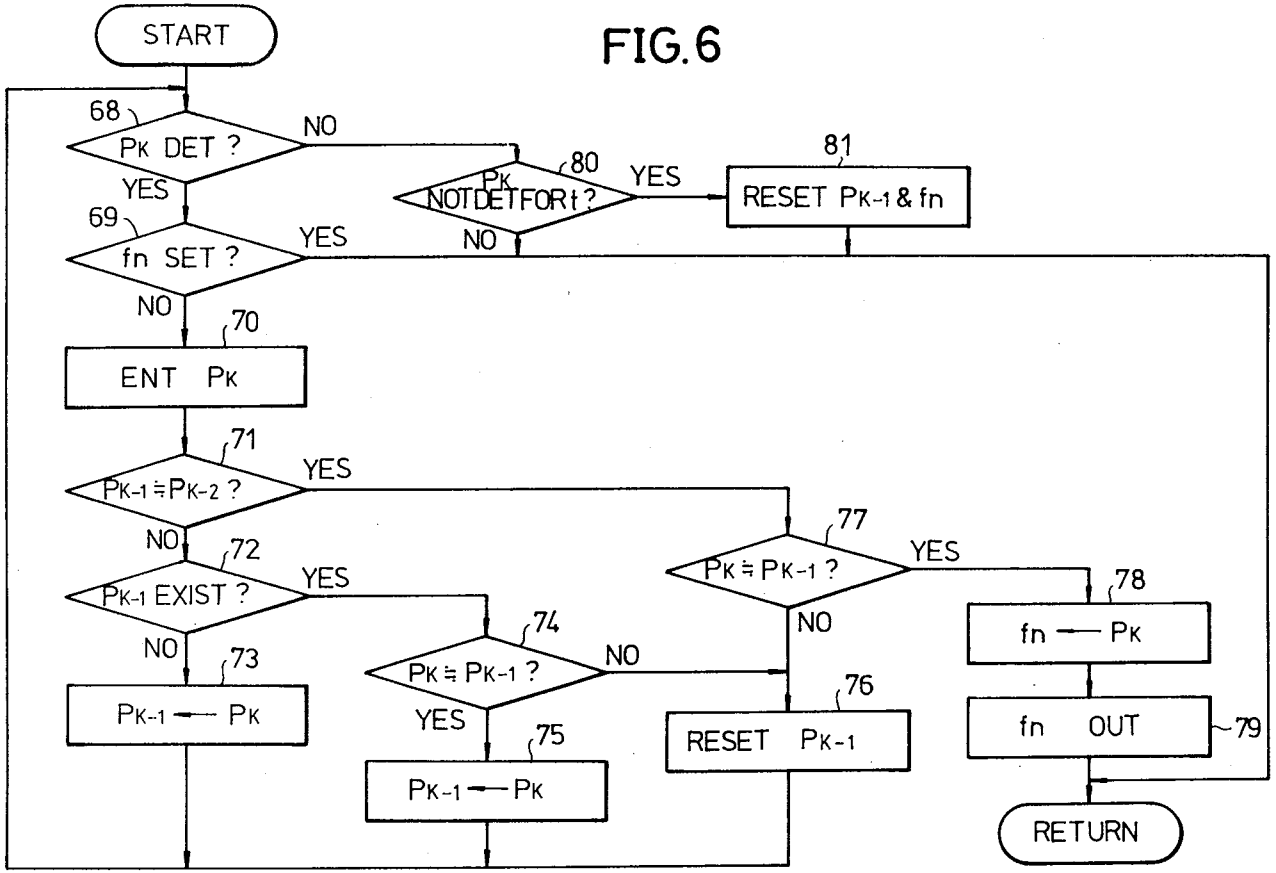
FIG. 6 is a flow chart for explaining an embodiment of the operation of a microcomputer when a preliminary pitch setting circuit in the block system shown in FIG. 1 is constituted by the microcomputer.

In FIG. 6, a step 68 discriminates whether or not a pitch $P_k$ is detected. When the discrimination result in the step 68 is YES, a step 69 discriminates whether or not the preliminary pitch fn is set. When the discrimination result in the step 69 is NO, a step 70 enters the pitch $P_k$ from the quantization circuit 13, and a step 71 discriminates whether or not approximately equal pitches are successively obtained for a certain number of times (for example, two times and pitches $P_{k-2}$ and $P_{k-1}$ are approximately equal to each other). When the discrimination result in the step 71 is NO, a step 72 discriminates whether or not a previous pitch $P_{k-1}$ obtained immediately prior to the present pitch $P_k$ exists. When the discrimination result in the step 72 is NO, a step 73 sets the present pitch $P_k$ as the previous pitch $P_{k-1}$ and the operation returns to the step 68. On the other hand, when the discrimination result in the step 72 is YES, a step 74 discriminates whether or not the present pitch $P_k$ is approximately equal to the previous pitch $P_{k-1}$. When the discrimination result in the step 74 is YES, a step 75 sets the present pitch $P_k$ as the previous pitch $P_{k-1}$ and the operation returns to the step 68. When the discrimination result in the step 74 is NO, a step 76 resets the previous pitch $P_{k-1}$ and the operation returns to the step 68.

When the discrimination result in the step 71 is YES, a step 77 discriminates whether or not the present pitch $P_k$ is approximately equal to the previous pitch $P_{k-1}$. In other words, the steps 71 and 77 together discriminate whether or not approximately the same pitches (quantization levels) are successively obtained for three times. When the discrimination result in the step 77 is YES, a step 78 sets the pitch $P_k$ as the preliminary pitch fn and a step 79 produces a preliminary pitch signal which indicates the preliminary pitch fn as an output. When the discrimination result in the step 77 is NO, the operation advances to the step 76.

On the other hand, when the discrimination result in the step 68 is NO, a step 80 discriminates whether or not the pitch $P_k$ is not detected for over a specific time t (for example, 80 msec). When the pitch $P_k$ is not detected for over the specific time t and the discrimination result in the step 80 is YES, a step 81 resets the previous pitch $P_{k-1}$ and the preliminary pitch fn and the operation returns to the original step. When the discrimination result in the step 80 is NO or when the discrimination result in the step 69 is YES, the operation also returns to the original step.

Figure 2:
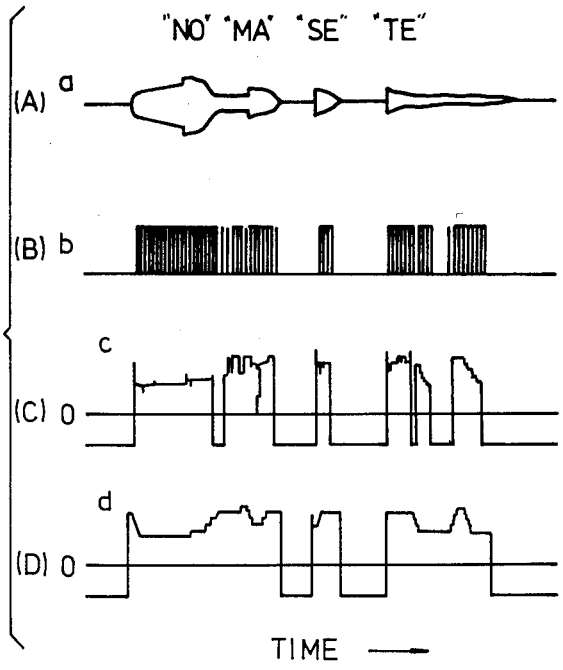
FIGS. 2(A) through 2(D) show signal waveforms for explaining the operation of the block system shown in FIG. 1.

The pitch correcting circuit 15 is supplied with the quantized signal c (pitch $P_k$) and the preliminary pitch signal which indicates the preliminary pitch fn, and generates a signal d shown in FIG. 2(D) in which the quantized signal c is corrected of the pitch thereof by correcting the preliminary pitch fn. This output signal d of the pitch correcting circuit 15 is obtained through an output terminal 16. The operation of the pitch correcting circuit 15 may be carried out by use of a microcomputer, and the operation of the microcomputer in this case is shown in the flow chart of FIG. 7. For example, the microcomputer μPD1512AC manufactured by Nippon Electric Co., Ltd. of Japan which is used for the quantization circuit 13 described before, may also be used for the microcomputer which is to carry out the operation of the pitch correcting circuit 15.

Figure 7:
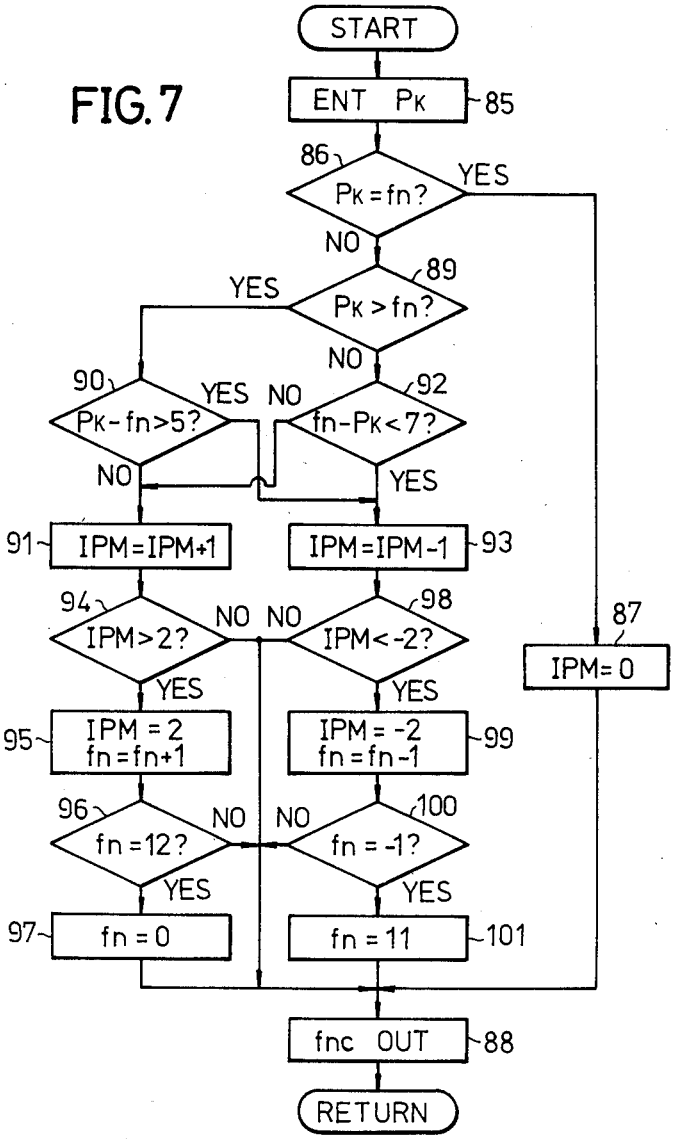
FIG. 7 is a flow chart for explaining an embodiment of the operation of a microcomputer when a pitch correcting circuit in the block system shown in FIG. 1 is constituted by the microcomputer.

In FIG. 7, a step 85 enters the quantized signal c, that is, the pitch $P_k$ from the quantization circuit 13. A step 86 discriminates whether or not the pitch $P_k$ is equal to the preliminary pitch fn obtained from the preliminary pitch setting circuit 14. When the discrimination result in the step 86 is YEs, a counted value IPM in an up-down counter within the microcomputer is reset to zero, a step 88 produces the signal d having a pitch fnc as an output, and the operation returns to the step 85. When the discrimination result in the step 86 is NO, a step 89 discriminates whether or not the pitch $P_k$ is higher than the preliminary pitch fn, and in the case where the discrimination result in the step 89 is YES, a step 90 discriminates whether or not $P_k$-fn is greater than "5". When the discrimination result in the step 90 is NO, a step 91 increments the counted value IPM by one. When the discrimination result in the step 90 is YES, a step 93 decrements the counted value IPM by one. When the discrimination result in the step 89 is NO, a step 92 discriminates whether or not fn-$P_k$ is smaller than "7". The operation advances to the step 93 when the discrimination result in the step 92 is YES, and the operation advances to the step 91 when the discrimination result in the step 92 is NO.

A step 94 discriminates whether or not the counted value IPM is greater than "2", and in the case where the discrimination result in the step 94 is YES, a step 95 sets the counted value IPM to "2" and increments the preliminary pitch fn by one. A step 96 discriminates whether or not the preliminary pitch fn is equal to "12", and in the case where the discrimination result in the step 96 is YES, a step 97 sets the preliminary pitch fn to "0" to obtain the corrected preliminary pitch fnc before advancing to the step 88. A step 98 discriminates whether or not the counted value IPM is smaller than "−2", and in the case where the discrimination result in the step 98 is YES, a step 99 sets the counted value IPM to "−2" and decrements the preliminary pitch fn by one. A step 100 discriminates whether or not the preliminary pitch fn is equal to "−1", and in the case where the discrimination result in the step 100 is YES, a step 101 sets the preliminary pitch fn to "11" to obtain the corrected preliminary pitch fnc before advancing to the step 88. When the discrimination result in the step 94, 96, 98, or 100 is NO, the operation advances to the step 88.

According to the pitch correction described above, the step 87 is performed at a part where the pitch does not change, and the output pitch fnc is maintained. On the other hand, predetermined steps out of the steps 90 through 101 are performed at a part where the pitch changes, and the output pitch fnc changes immediately responsive to the change in the pitch. In other words, the processing can be performed in real-time. In this case, the counted value IPM is repeatedly incremented or decremented, and the pitch correcting circuit 15 does not respond to a change in the pitch of an extremely high frequency such as a noise, and as a result, the pitch correcting circuit 15 is essentially unaffected by the noise.

In the description given heretofore, it is described for convenience' sake that the quantization circuit 13, the preliminary pitch setting circuit 14, and the pitch correcting circuit 15 are constituted by the microcomputer. However, the quantization circuit 13, the preliminary pitch setting circuit 14, and the pitch correcting circuit 15 may be constituted by appropriate hardware.

Next, description will be given with respect to other embodiments of the operations of the microcomputer for the case where the quantization circuit 13, the preliminary pitch setting circuit 14, and the pitch correcting circuit 15 are constituted by the microcomputer. In the embodiments of the operations of the microcomputer described before, the quantization level is limited to "12". However, in the embodiments which will be described hereinafter, the quantization level is assumed to be equal to L.

Figure 8:
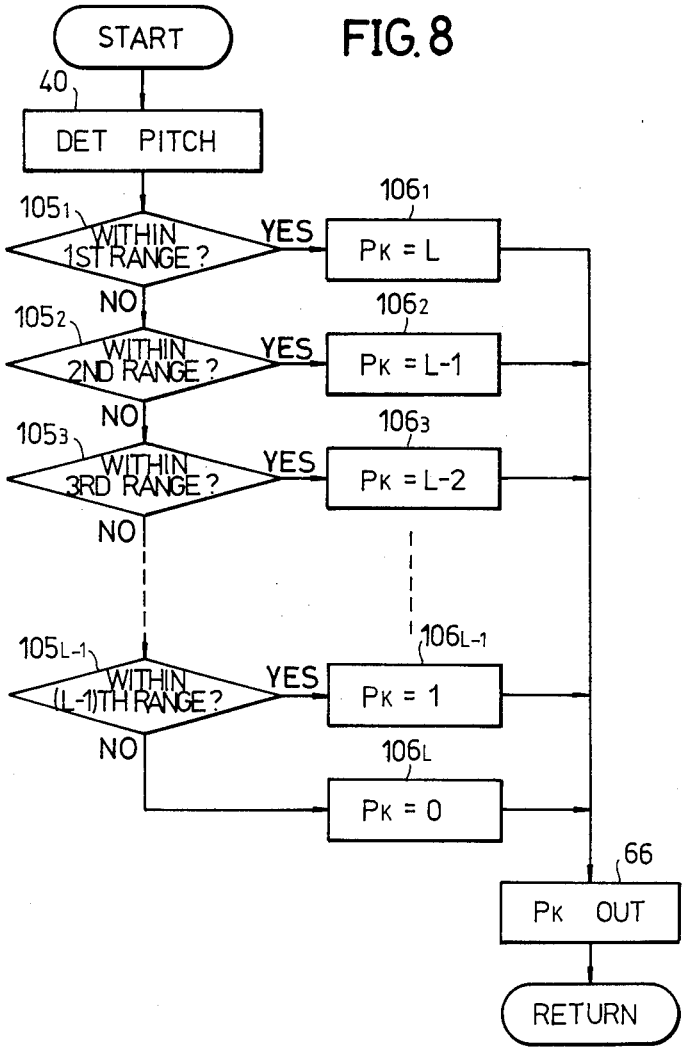
FIG. 8 is a flowchart for explaining another embodiment of the operation of the microcomputer when the quantization circuit in the block system shown in FIG. 1 is constituted by the microcomputer.

FIG. 8 shows the other embodiment of the operation of the microcomputer when the quantization circuit 13 is constituted by the microcomputer. In FIG. 8, those parts which are the same as those corresponding parts in FIG. 5 are designated by the same reference numerals, and description thereof will be omitted. A step $\mathbf{105}_1$ discriminates whether or not the pitch detected in the step 40 is within such a first range that the pitch can be recognized as a pitch name described by a quantization level "L". When the discrimination result in the step $\mathbf{105}_1$ is YES, a step $\mathbf{106}_1$ sets the pitch $P_k$ to the quantization level "L". On the other hand, when the discrimination result in the step $\mathbf{105}_1$ is NO, a step $\mathbf{105}_2$ discriminates whether or not the pitch detected in the step 40 is within such a second range that the pitch can be recognized as a pitch name described by a quantization level "L−1". Similarly thereafter, steps $\mathbf{105}_3$ through $\mathbf{105}_{L-1}$ and $\mathbf{106}_2$ through $\mathbf{106}_L$ are performed depending on the discrimination results, and the pitch $P_k$ is produced as the output in the step 66 as in the case of the embodiment of the operation of the microcomputer described before.

In the present embodiment of the operation of the microcomputer, the operation of the microcomputer when the preliminary pitch setting circuit 14 is constituted by the microcomputer is substantially the same as the operation described before in conjunction with FIG. 6, and description thereof will accordingly be omitted.

Figure 9:
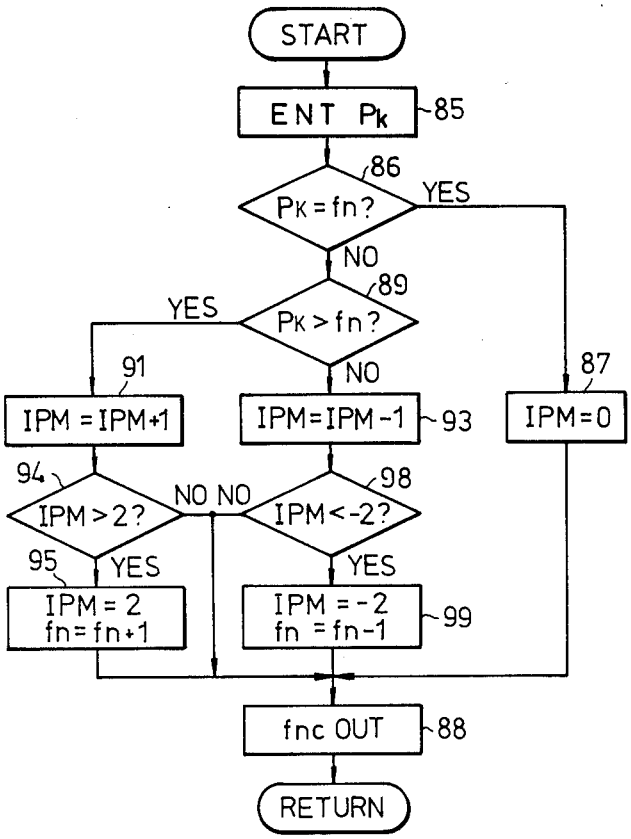
FIG. 9 is a flow chart for explaining another embodiment of the operation of the microcomputer when the pitch correcting circuit in the block system shown in FIG. 1 is constituted by the microcomputer.

FIG. 9 shows the other embodiment of the operation of the microcomputer when the pitch correcting circuit 15 is constituted by the microcomputer. In FIG. 9, those parts which are the same as those corresponding parts in FIG. 7 are designated by the same reference numerals, and description thereof will be omitted. The operation shown in FIG. 9 does not have the steps 90, 92, 96, 97, 100, and 101 shown in FIG. 7, but the rest of the operation is substantially the same as the operation shown in FIG. 7, and description thereof will be omitted for this reason.

Figure 10:
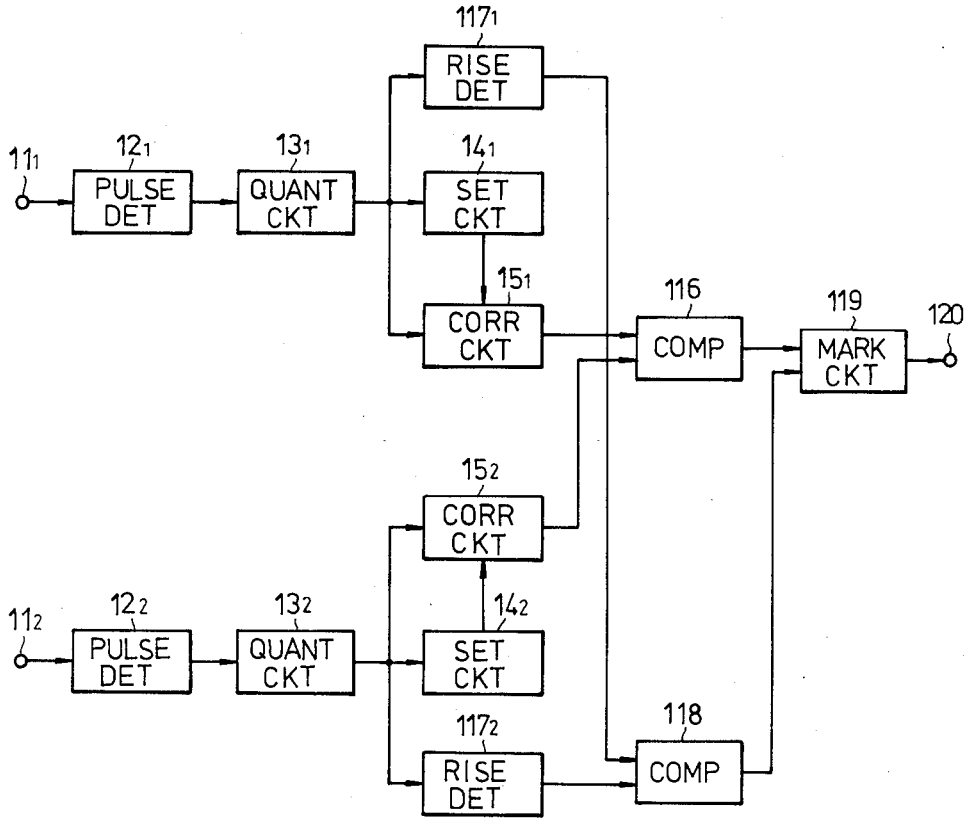
FIG. 10 is a system block diagram showing an embodiment of a song marking apparatus which may be applied with the voice signal to pitch signal conversion system according to the present invention.

Next, description will be given with respect to an embodiment of a song marking apparatus which may be applied with the voice signal to pitch signal conversion system according to the present invention, so as to facilitate the understanding of the operation and use of the voice signal to pitch signal conversion system. FIG. 10 is a system block diagram generally showing the embodiment of the song marking apparatus. In FIG. 10, those parts which are the same as those corresponding parts in FIG. 1 are designated by the same reference numerals, and further, circuits for processing a first voice signal of a song sung by a teacher (model song) are identified with a subscript "1" and circuits for processing a second voice signal of the song sung by a student, for example, are identified with a subscript "2". The operation of the processing system for the first voice signal is substantially the same as the operation of the processing system shown in FIG. 1, and the operation of the processing system for the first voice signal is substantially the same as that of the processing system for the second voice signal. For this reason, description of the processing systems for the first and second voice signals will be omitted. For example, the model first voice signal is reproduced from a recording medium (not shown) such as magnetic tape and is applied to a terminal $11_1$. On the other hand, the second voice signal which is to be marked is obtained from a microphone (not shown), for example, and is applied to an input terminal $11_2$.

The first and second voice signals are passed through the respective processing systems which are similar to each other, and are supplied to a pitch comparing circuit 116. The pitch comparing circuit 116 compares the pitches of the first and second voice signals when the first and second voice signals are maintained for over 80 msec, for example. For example, the pitch comparing circuit 116 detects four levels of demerit mark elements in accordance with the difference in the pitches of the first and second voice signals.

Figures 11, 12:
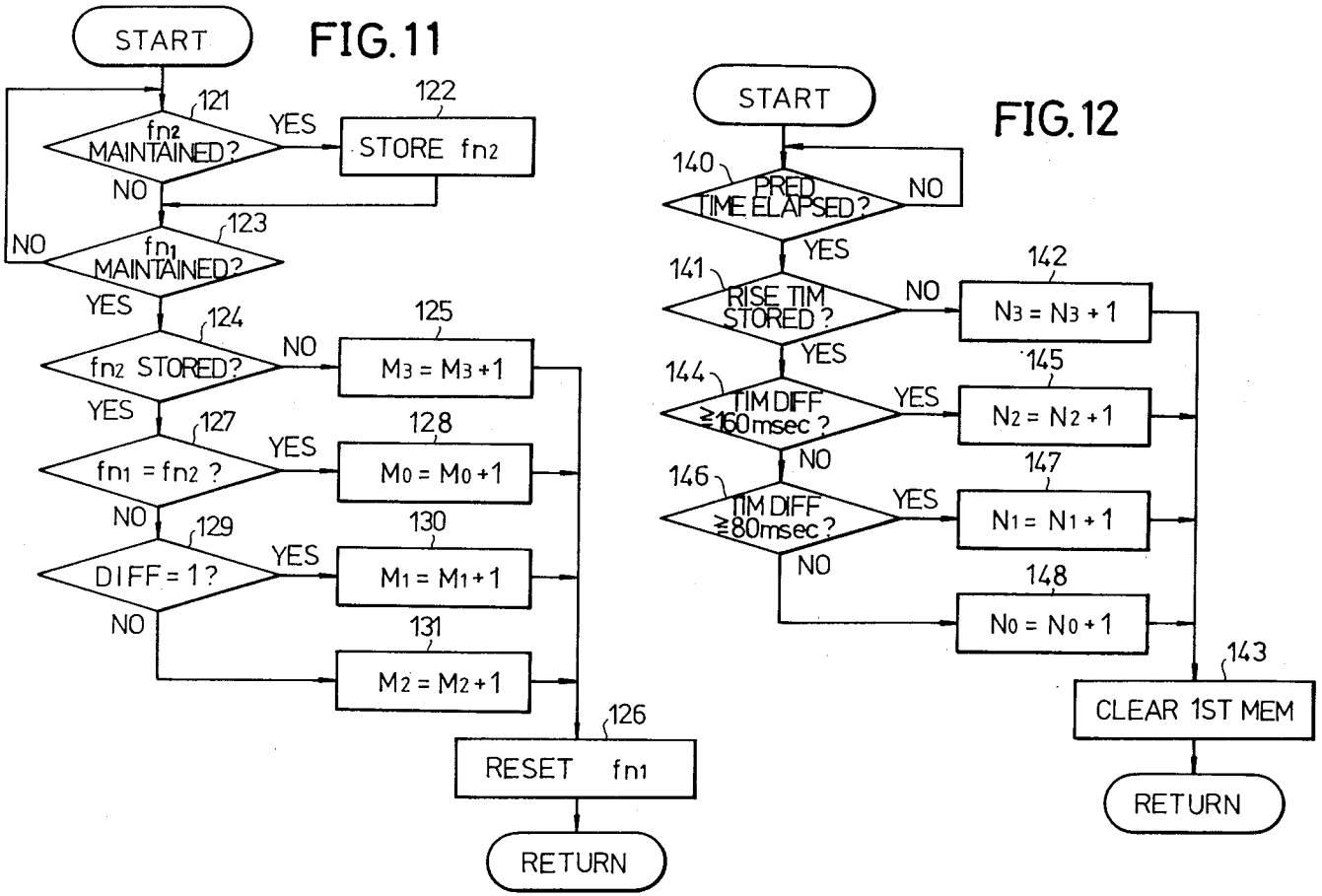
FIGS. 11 through 13 are flow charts for explaining operations of a microcomputer when parts of the song marking apparatus shown in FIG. 10 are constituted by the microcomputer.

FIG. 11 is a flow chart showing the operation of the microcomputer when the pitch comparing circuit 116 is constituted by the microcomputer. When first and second pitches obtained from pitch correcting circuits $15_1$ and $15_2$ are respectively designated by fn1 and fn2, a step 121 discriminates whether or not the second pitch fn2 is maintained for over a specific time (for example, 80 msec). When the discrimination result in the step 121 is YES, a step 122 stores the second pitch fn2 into a memory within the microcomputer and the operation then advances to a step 123. When the discrimination result in the step 121 is NO, the operation advances directly to the step 123. The step 123 discriminates whether or not the first pitch fn1 is maintained for a specific time (for example, 80 msec), and the operation returns to the step 121 when the discrimination result in the step 123 is NO. When the discrimination result in the step 123 is YES, a step 124 discriminates whether or not the second pitch fn2 is stored in the memory.

When the discrimination result in the step 124 is NO, a step 125 increments a counted value in a counter $M_3$ within the microcomputer by one and the operation advances to a step 126. On the other hand, when the discrimination result in the step 124 is YES, a step 127 discriminates whether or not the first pitch fn1 is equal to the second pitch fn2. When the discrimination result in the step 127 is YES, a step 129 increments a counted value in a counter $M_0$ within the microcomputer by one and the operation advances to the step 126. When the discrimination result in the step 127 is No, a step 129 discriminates whether or not a difference between the first and second pitches fn1 and fn2 is equal to "1". A step 130 increments a counted value in a counter $M_1$ within the microcomputer by one when the discrimination result in the step 129 is YES, and a step 131 increments a counted value in a counter $M_2$ within the microcomputer by one when the discrimination result in the step 129 is NO. After the step 130 or 131, the step 126 is performed. The step 126 resets the first pitch fn1.

Outputs of quantization circuits $13_1$ and $13_2$ are supplied to respective rise detecting circuits $117_1$ and $117_2$ wherein the timings of the rises are detected. A rise comparing circuit 118 compares the timings of the rises detected in the rise detecting circuits $117_1$ and $117_2$, and for example, detects four levels of demerit mark elements in accordance with the difference between the two detected timings of the rises.

FIG. 12 is a flow chart showing the operation of the microcomputer when the rise comparing circuit 118 is constituted by the microcomputer. When the detected timings of the rises are obtained from the rise detecting circuits $117_1$ and $117_2$, a step 140 discriminates whether or not a predetermined time (for example, 150 msec) has elapsed from a time when the timing of the rise detected in the rise detecting circuit $117_1$ is stored into a first memory within the microcomputer. The step 140 is repeatedly performed until the discrimination result becomes YES. When the discrimination result in the step 140 becomes YES, a step 141 discriminates whether or not the timing of the rise detected in the rise detecting circuit $117_2$ is stored into a second memory within the microcomputer. When the discrimination result in the step 141 is NO, a step 142 increments a counted value in a counter $N_3$ within the microcomputer by one and a step 143 clears the first memory.

On the other hand, when the discrimination result in the step 141 is YES, a step 144 discriminates whether or not a time difference between the timings of the rises detected in the rise detecting circuits $117_1$ and $117_2$ is over 160 msec, for example. When the discrimination result in the step 144 is YES, a step 145 increments a counted value in a counter $N_2$ within the microcomputer by one and the operation advances to the step 143. When the discrimination result in the step 144 is NO, a step 146 discriminates whether or not the time difference between the timings of the rises is over 80 msec, for example. When the discrimination result in the step 146 is YES, a step 147 increments a counted value in a counter $N_1$ within the microcomputer by one and the operation advances to the step 143. On the other hand, when the discrimination result in the step 146 is NO, a step 148 increments a counted value in a counter $N_0$ within the microcomputer by one and the operation advances to the step 143.

Outputs of the pitch comparing circuit 116 and the rise comparing circuit 118 are supplied to a marking circuit 119 wherein a weighting is performed for each of the four levels of demerit mark elements and the mark is calculated. The calculated mark is obtained through an output terminal 120.

Figure 13:
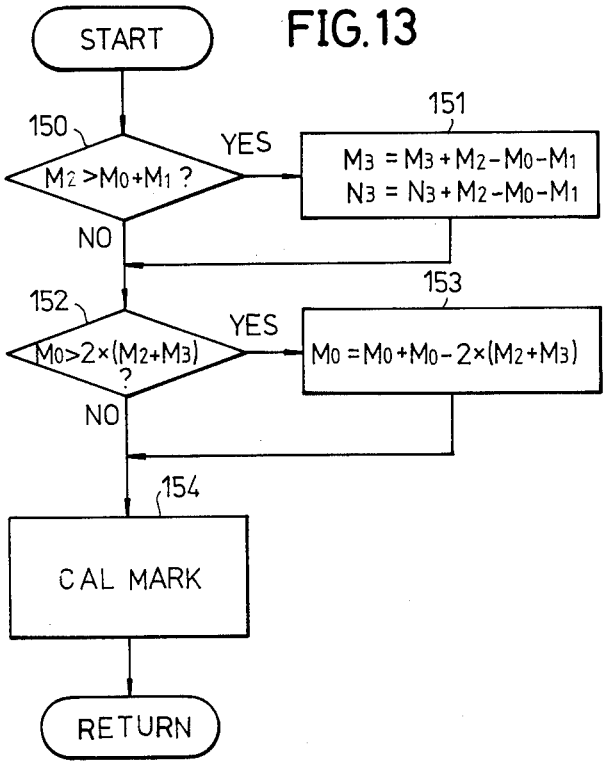

FIG. 13 is a flow chart showing the operation of the microcomputer when the marking circuit 119 is constituted by the microcomputer. A step 150 discriminates whether or not $M_2$ is greater than $M_0+M_1$, where $M_2$ represents the counted value in the counter $M_2$, $M_0$ represents the counted value in the counter $M_0$ and $M_1$ represents the counted value in the counter $M_1$. For convenience' sake, the counted values of the other counters will hereinafter be represented in a similar manner. When the discrimination result in the step 150 is YES, a step 151 performs a first calculation which consists of calculating $M_3=M_3+M_2-M_0-M_1$ and calculating $N_2=N_2+M_2-M_0-M_1$. A step 152 is performed after the step 151 or when the discrimination result in the step 150 is NO. The step 152 discriminates whether or not $M_0$ is greater than $2\times(M_2+M_3)$. When the discrimination result in the step 152 is YES, a step performs a second calculation which consists of calculating $M_0=M_0+M_0-2\times(M_2+M_3)$. After the step 153 or when the discrimination result in the step 152 is NO, a step 154 performs a third calculation to obtain the mark. The third calculation consists of the following.

$$\text{Mark}=[(M_0+0.75\times M_1+0.5\times M_2-M_3)/(M_0+M_1+M_2+M_3)+(N_0+0.75\times N_1+0.5\times N_2-N_3)/(N_0+N_1+N_2+N_3)]\times 50$$

By performing the process shown in FIG. 5, it is possible to correctly mark the song even when the student sings with an octave difference with respect to the model song.

Further, the present invention is not limited to these embodiments, but various variations and modifications may be made without departing from the scope of the present invention.

What is claimed is:

1. A system for converting a voice signal to a pitch signal, said system comprising:

first means for obtaining a pulse signal having a period corresponding to peak values of an input voice signal;

second means for quantizing the pulse signal supplied from said first means and for generating a quantized signal;

third means supplied with the quantized signal from said second means for setting the quantized signal as a preliminary pitch signal which indicates a preliminary pitch when the quantized signal assumes the same quantization level successively for a predetermined number of times; and fourth means supplied with the quantized signal from said second means and the preliminary pitch signal from said third means for correcting the preliminary pitch signal by raising or lowering the preliminary pitch when a pitch described by said quantized signal and said preliminary pitch are not equal to each other, said fourth means generating a pitch signal which indicates a pitch of said input voice signal.

2. A system as claimed in claim 1 in which said first means comprises an automatic level control circuit supplied with said input voice signal for automatically controlling a level of said input voice signal, and a wave shaping circuit for generating said pulse signal by shaping a waveform of an output of said automatic level control circuit.

3. A system as claimed in claim 1 in which said second means converts said pulse signal into a quantized signal having twelve quantization levels in correspondence with twelve pitch names of a predetermined octave.

4. A system as claimed in claim 1 in which said second means multiplies ½ to a pitch described by said pulse signal when the pitch is higher than a predetermined pitch and converts said pulse signal into a quantized signal having twelve quantization levels in correspondence with twelve pitch names of a predetermined octave by detecting a certain range in which the pitch exists out of a plurality of ranges, said pitch within said certain range being recognized as a pitch name described by a certain quantization level out of the twelve quantization levels.

5. A system as claimed in claim 1 in which said third means sets the quantized signal as the preliminary pitch signal which indicates the preliminary pitch when the quantized signal assumes the same quantization level successively for three times.

6. A system as claimed in claim 1 in which said fourth means generates a corrected preliminary pitch signal by incrementing a quantization level of the preliminary pitch signal when a quantization level of the quantized signal is greater than the quantization level of the preliminary pitch signal and by decrementing the quantization level of the preliminary pitch signal when the quantization level of the quantized signal is smaller than the quantization level of the preliminary pitch signal.

7. A system as claimed in claim 1 in which said second means converts said pulse signal into a quantized signal having L quantization levels in correspondence with pitch names of predetermined octaves where L is a positive integer.

8. A system as claimed in claim 1 in which said fourth means comprises means for storing a counted value which is incremented when a quantization level of the quantized signal is greater than a quantization level of the preliminary pitch signal, decremented when the quantization level of the quantized signal is smaller than the quantization level of the preliminary pitch signal, and is set to zero when the quantization level of the quantized signal is equal to the quantization level of the preliminary pitch signal, said fourth means generating a corrected preliminary pitch signal by incrementing the quantization level of the preliminary pitch signal when the quantization level of the quantized signal is greater than the quantization level of the preliminary pitch signal and said counted value is greater than a first predetermined value, said fourth means generating a corrected preliminary pitch signal by decrementing the quantization level of the preliminary pitch signal when the quantization level of the quantized signal is smaller than the quantization level of the preliminary pitch signal and said counted value is smaller than a second predetermined value.

9. A system as claimed in claim 8 in which said first and second predetermined counted values are equal to 2 and −2, respectively.

10. A system as claimed in claim 1 in which said second, third, and fourth means are constituted by a microcomputer.

* * * * *